US006763554B1

(12) United States Patent
Torrey et al.

(10) Patent No.: US 6,763,554 B1
(45) Date of Patent: Jul. 20, 2004

(54) SELF-ENGAGING STRAP-FORM TIE WITH SPECIAL TAB

(76) Inventors: Ralph H. Torrey, 2021 Sea Hawk Cir., Ponte Vedra Beach, FL (US) 32082; Lis N. Torrey, P.O. Box 88744, Atlanta, GA (US) 30356

( * ) Notice: Subject to any disclaimer, the term of this patent is extended or adjusted under 35 U.S.C. 154(b) by 0 days.

(21) Appl. No.: 10/348,860

(22) Filed: Jan. 22, 2003

Related U.S. Application Data

(60) Provisional application No. 60/350,794, filed on Jan. 22, 2002.

(51) Int. Cl.[7] ..... A44B 21/00; B65D 63/00

(52) U.S. Cl. ..... 24/30.5 P; 24/30.5 R; 24/306; 24/17 AP

(58) Field of Search ..... 24/30.5 R, 30.5 P, 24/17 AP, 16 PB, 16 R, 300, 302, 301, 306, 442

(56) References Cited

U.S. PATENT DOCUMENTS

| | | | | | |
|---|---|---|---|---|---|
| 3,000,384 | A | | 9/1961 | Piers, Jr. | 132/46 |
| 3,430,300 | A | * | 3/1969 | Doan | 24/304 |
| 4,149,540 | A | | 4/1979 | Hasslinger | 128/327 |
| 4,553,293 | A | * | 11/1985 | Blum | 24/712.2 |
| 4,672,722 | A | | 6/1987 | Malamed | 24/446 |
| 4,759,963 | A | * | 7/1988 | Uso, Jr. et al. | 428/100 |
| 4,815,172 | A | | 3/1989 | Ward | 24/16 R |
| 4,878,274 | A | | 11/1989 | Patricy | 24/306 |
| 4,893,381 | A | | 1/1990 | Frankel | 24/16 R |
| 4,939,818 | A | | 7/1990 | Hahn | 24/16 R |
| 4,955,981 | A | | 9/1990 | Provost | 383/86 |
| 5,048,158 | A | | 9/1991 | Koerner | 24/16 R |
| 5,104,076 | A | * | 4/1992 | Goodall, Jr. | 248/205.2 |
| 5,142,743 | A | | 9/1992 | Hahn | 24/16 R |
| 5,168,603 | A | | 12/1992 | Reed | 24/16 R |
| 5,312,387 | A | * | 5/1994 | Rossini et al. | 604/389 |
| 5,603,708 | A | * | 2/1997 | Seth | 604/389 |
| 5,604,961 | A | | 2/1997 | Cole | 24/306 |
| 5,802,676 | A | | 9/1998 | Tolan | 24/16 R |
| 5,913,483 | A | * | 6/1999 | Polk | 24/712.3 |
| 6,044,525 | A | | 4/2000 | Sastre et al. | 24/20 R |
| 6,205,623 | B1 | | 3/2001 | Shepard et al. | 24/30.5 R |
| 6,349,904 | B1 | | 2/2002 | Polad | 248/74.3 |
| 6,467,132 | B1 | | 10/2002 | Robley | 24/16 |
| 6,588,074 | B2 | * | 7/2003 | Galkiewicz et al. | 24/586.1 |

* cited by examiner

*Primary Examiner*—Robert J. Sandy

(57) ABSTRACT

A strap-form tie which makes use of self-engaging back-to-back hook and loop material (hooks on one of the tie and the loop component on the opposite surface), with a special tab on one end to facilitate wrapping. The tie overlaps itself and attaches to itself, adjusting to the diameter of the object(s) being enclosed. The tie is untied simply by peeling it apart, and it may be re-used repeatedly. This novel design makes practical many new uses for strap-form ties.

7 Claims, 9 Drawing Sheets

SELF-ENGAGING STRAP-FORM TIE WITH SPECIAL TAB

CROSS-REFERENCE TO RELATED APPLICATION

This application claims the benefit of Provisional Patent Application Serial No. 60/350,794 filed Jan. 22, 2002.

BACKGROUND

1. Field of Invention

This invention relates to strap-form wrap ties and closures, specifically to such ties as are used for closing the necks of plastic bags, are releasable, and are used as well for other purposes such as bundling wires, cords and cables, and for like applications.

2. Description of the Prior Art

The present invention makes use of the familiar VELCRO™ brand hook and loop fastening system. Invented over 40 years ago, the extraordinary Velcro system has over the years found literally thousands of applications and uses, and many patents have been issued for products that make use of hook and loop materials. Hence, much of the prior art to which we will refer will be products that employ the hook and loop fastening system.

One version of the Velcro™ type hook and loop fastening system is in the form of a strap wherein the hook component is permanently adhered to one face of the strap (which might be called the gripper face) and the loop component (often wooly in appearance) is permanently adhered to the opposite face of the strap. Such fasteners are often referred to as self-engaging back-to-back fasteners. The Velcro™ company calls this the "One-Wrap Brand" back-to-back fastener. The loop component may be of woven or knit or pile construction, or a web of entangled fibers, and this component is effectively engaged by the hook or gripper component simply by pressing the two components together by hand. The tie thus attaches to itself. The tie is also easy to "untie". One releases it from its grip on itself simply by peeling it away from itself. The tie holds very effectively for its purpose and it is reusable. It can be fastened and unfastened repeatedly without losing its effectiveness.

One use for a tie made of self-engaging back-to-back hook and loop fastener materials in strap form is for closing plastic bags. In that use, the tie is wrapped around the gathered open end of a bag (which we will call the neck of the bag) to close it effectively. Such closures are also easy to untie and remove and they may be reused repeatedly.

The closing of plastic bags with releasable ties or closures has presented an opportunity that has attracted numerous inventors and innovators. Numbers of patents have been issued for products which address this application.

Another important use for a strap tie is for wrapping and bundling wire, cord, tubing and the like. These strap-type ties and those disclosed in U.S. Pat. No. 6,467,132 B1 to Robley (2002), U.S. Pat. No. 6,349,904 to Polad (2002), U.S. Pat. No. 6,205,623 B1 to Shepard and Clune (2001), U.S. Pat. No. 6,044,525 to Sastre et al., U.S. Pat. No. 5,802,676 to Tolan (1998), U.S. Pat. No. 5,604,961 to Cole (1997), U.S. Pat. No. 5,168,603 to Reed (1992), U.S. Pat. No. 5,142,743 to Hahn (1992), U.S. Pat. No. 5,048,158 to Koerner (1991), U.S. Pat. No. 4,955,981 to Provost (1990), U.S. Pat. No. 4,939,818 to Hahn (1990), U.S. Pat. No. 4,893,381 to Frankel (1990), U.S. Pat. No. 4,878,274 to Patricy (1989) U.S. Pat. No. 4,815,172 to Ward (1989), U.S. Pat. No. 4,672,722 to Malamed (1987), U.S. Pat. No. 4,149,540 to Hasslinger (1 979), and U.S. Pat. No. 3,000,384to Piers, Jr. (1961) all suffer variously from disadvantages such as complexity, complication, clumsiness in use, the need for accessory products such as buckles, slides and keepers, or the need for special orientation of parts, segments, or components. These disadvantages are in some cases compounded by high cost to manufacture. U.S. Pat. No. 5,913,483 to Polk discloses a shoe lace securing device, illustrated in our FIGS. 9, 10, 11 and 12. There is a tab shape on at least one end of the device. Attached by adhesive or other means to a first surface of the device at one end only is a patch with loop material on the patch (FIG. 9–34 and FIG. 10–34). The rest of the first surface is smooth and is used for printing or ornamental decoration. The opposite surface of the device is completely covered with hook material. FIGS. 13 and 14 show one embodiment of the Polk device being applied to the laces of a shoe. In the installation, the device is placed underneath the shoe laces at the knot, hook surface up. The tab end is folded up and over the shoe lace knot, the hook surface engaging the knot and the adjacent laces, the hook faced tab overlapping and mating with the small loop faced patch on the opposite end of the opposite face of the device, thus securing the knot as well as hiding it—which is its stated purpose. FIG. 15 shows the finished installation. The attractively decorated face of the tab is outermost, and virtually all that we see. The Polk apparatus has done its job.

The short device of the Polk patent (U.S. Pat. No. 5,913,483) accomplishes its limited purpose quite adequately—which is to secure and cover a shoe lace knot. But it cannot be used, nor was it intended to be used, as an adjustable tie for the broad range of binding tasks for which our tie was designed. Such tasks include adjustably binding bags of many different types, different sizes, different materials, and different neck diameters; as well as adjustably binding a variety of different products such as cords, cables, fibers, tubingand the like in a bundling type of operation—all of these examples being binding tasks for which our tie is eminently well suited. Perhaps the simplest and most popular tie in the general category of strap-form ties is the type illustrated in FIGS. 1 and 5 in U.S. Pat. No. 6,044,525 to Satire and others (2000), and illustrated in our FIGS. 3A, 3B and 3C. In addition to straps such as those just mentioned, strips cut from sheets of Velcro-type self-engaging back-to-back hook and loop material, as well as the same material in tape form and available in the marketplace, can also be used for the applications already referred to.

However, as useful as the back-to-back strap ties are, there are disadvantages and limitations. Referring again to FIGS. 1 and 5 of U.S. Pat. No. 6,044,525, and illustrated in our FIGS. 3A, 3B and 3C, referred to in the above paragraph, note that a slot 16 has been cut into the slightly widened end of each strap. This end is wider than the strap body in order to accommodate the slot through which the strap will pass. The first disadvantage of this otherwise very useful tie is that in using the tie for bundling a number of wires, cords or cables, one should (as advised by the manufacturer) first wrap the tie around a single cord or cable, push the tie through the slot, pull it up tight, and then having thus anchored the strap, wrap it around the rest of the bundle, pressing the strap onto itself to complete the tie. This rather cumbersome anchoring step, during which the tie tends to get caught as it passes through the slot shown in FIG. 3B, becomes unnecessary, as will be seen, with the tie of the present invention.

The second disadvantage of the strap tie as shown in FIGS. 1 and 5 of U.S. Pat. No. 6,044,525 to Sastre et al.

(2000) and illustrated in our FIGS. 3A, 3B and 3C is that it is not well suited to many binding tasks, being too wide, as presently targeted, for many applications. (If too long, one simply cuts off the excess.) If one prefers not to use the tie in strap form with the slot, and just buy the Velcro™ brand or other brand back-to-back self-adhering material in roll or sheet form, it is available only in ⅝" minimum width. If one prefers to use a strap in narrower dimension as better suited to the task at hand, he might himself cut, or have cut by a converter, strips of narrower dimensions. However, in wrapping something with a narrow strap, say, ⅜" wide, there is still a disadvantage. It would be hard to anchor one end of the strap and then wrap it tightly and neatly around an object, because the thumb keeps getting in the way. The wrapping hence becomes awkward, clumsy and unsatisfactory.

U.S. Patents Considered Relevant References

We list below all patents which we have found, or which have been called to our attention, which we consider to be relevant references in the context of this application. The list includes patents which were specifically cited in the foregoing text, as well as patents considered not to require special comment.

| | | | | | |
|---|---|---|---|---|---|
| 3,000,384 | Piers, Jr. | 9/1961 | 5,802,676 | Tolan | 9/1998 |
| 3,430,300 | Doan | 3/1969 | 5,913,483 | Polk | 6/1999 |
| 4,149,540 | Hasslinger | 4/1979 | 6,044,525 | Sastre et al. | 4/2000 |
| 4,553,293 | Blum | 11/1985 | 6,205,623 B1 | Shepard & Clune | 3/2001 |
| 4,672,722 | Malamed | 6/1987 | 6,349,904 | Polad | 2/2002 |
| 4,759,963 | Uso, Jr. et al. | 7/1988 | 6,467,132 B1 | Robley | 10/2002 |
| 4,815,172 | Ward | 3/1989 | 6,481,063 | Shepard et al. | 11/2002 |
| 4,878,274 | Patricy | 11/1989 | 6,588,074 | Galkiewicz et al. | 7/2003 |
| 4,893,381 | Frankel | 1/1990 | | | |
| 4,939,818 | Hahn | 7/1990 | | | |
| 4,955,981 | Provost | 9/1990 | | | |
| 5,048,158 | Koerner | 9/1991 | | | |
| 5,104,076 | Goodall, Jr. | 4/1992 | | | |
| 5,142,743 | Hahn | 9/1992 | | | |
| 5,168,603 | Reed | 12/1992 | | | |
| 5,312,387 | Rossini et al. | 5/1994 | | | |
| 5,518,795 | Kennedy et al. | 5/1996 | | | |
| 5,603,708 | Seth | 2/1997 | | | |
| 5,604,961 | Cole | 2/1997 | | | |

The Use for the Tie as Initially Addressed

We subscribe to the maxim often addressed to would-be inventors and marketers. "If you would be successful, find a need and fill it." This is what we did in the context of the present invention.

For some time we have felt that there was a need for a simple and efficient means to close and tie the open end of a bread bag. Loaves of bread sold in food stores and supermarkets are wrapped first in plastic film or waxed paper, the ends heat sealed to exclude air to keep the loaves fresh. The wrapped loaf is then put into another, outer plastic bag for the consumer to store the bread as the loaf is used up. (The inner bag will have been torn and discarded.) The outer bag is roughly the size and shape of the loaf, and as sold in stores, the open end closed by either of two means: (1) a "twist-tie" (a tie made of paper covered wire, or a similar tie made of plastic that performs essentially in the same way); (2) the second means of closure is a clip die cut out of flexible plastic sheet. This clip has a configuration similar to the drawing in FIG. 1.

Both of these means work reasonably well as bag closures, but they work less than satisfactorily for repeated opening and re-closing by the consumer. Even after first use, the twist-tie becomes deformed and after repeated use it becomes increasingly deformed and is not a pleasure to use. Furthermore, when untwisting these ties, one is never sure whether to go in a clockwise or counterclockwise direction, because the deformed tie makes it virtually impossible to tell at a glance which way to untwist. Altogether, this is a source of annoyance.

The plastic clip is efficient in keeping the bag closed, but the pointed projections inside the clip, which keep the bag closed while handling, make the clip hard to take off, and the clip is very hard to put back on. These clips were designed to keep the bag closed; they were not designed for customer convenience. So this is another source of annoyance for the consumer, who is left to his or her own devices to close, open, and then re-close the bread bag repeatedly as the contents are used up.

Inventors have recognized this problem and the associated opportunity, and several different designs for closures have appeared on the market. One such closure is in the form of a clasp or clamp about 2½" long, with hinged jaws that open like a "V", and then clamp down tight, with a catch at the open end, which holds the clasp closed. This clasp is not unlike a common hair clasp. Such a device requires that the gathered open end of the bag be spread more or less evenly within the jaws of the clasp in order for it to close the bag effectively and then to engage the snap catch that holds the clasp closed. Accordingly, this type of closure does not appear to have gained wide acceptance in the marketplace.

We found another type of clip in a store a year or two ago but have not seen it anywhere since. This clip, intended for the same purpose (bread bag closure) was made of plastic, and looked approximately like the drawing in FIG. 2. The clip had a "V"-type opening, and a spring-like action, so that it would open at 24 where the neck of the bag would be inserted, and then, under tension, close again over the neck of the bag. The bag would be held within the loop at 26. The hook shape identified as 28 in FIG. 2 was presumably intended to help the user pull the clip onto the neck of the plastic bag. Experimenting showed us that this clip is actually not very convenient to use. A further limitation is the fact that the loop in FIG. 2–26, which is intended to hold the neck of the bag in a closed state, is of finite size. Thus, depending on the size of the bag and the thickness of the plastic, some bags would be held tightly closed ideally, while other bags may not be closed tightly enough to exclude air, which is its essential purpose. There is no adjustability. These limitations may account for its apparent lack of success in the marketplace.

A third type of clip we found in just one store two years ago is essentially a variation of the familiar spring-activated paper clip or clamp. One squeezes the handles, and the clip opens to be placed around the neck of a bag, and then one releases the handles so that the clip or clamp under spring tension re-closes around the neck of the bag. This clip seems not to have found favor and seems to have disappeared from the marketplace.

We mention these various devices to make the point that there appears to be recognition of "the need" (a simple and efficient reusable closure for a bread bag), but that a satisfactory solution has so far not appeared.

We believe that the present invention is a good solution to the problems presented above, and will have appeal in the marketplace for its simplicity, its effectiveness, and its modest cost.

Moreover, while conceived for the bread bag, it is obvious that the closure of the present invention can be used for many other and sizes of plastic bags used for retail products and in industry. It can also he used to wrap and secure wires and cords used on computers and office machines, on appliances, tools, electronic devices, and the like, being especially useful where the thing being tied is of a relatively smaller dimension.

Objects and Advanyages

Accordingly, beside the advantages in inherent in the Velcro™-type hook and loop fastener system, in particular the self-engaging back-to-back variation of the hook and loop tie which our invention employs, and as described in the foregoing discussion, several objects and advantages will become apparent.

For the sake of convenience in reviewing all objects and advantages we desire to present, we list below those previously mentioned in the foregoing text, as well as others not specifically noted heretofore.

(a) to provide a flexible bag tie which is simple in concept, effective in its performance, easy to use, quick to apply, is adjustable, and is neat in appearance (b) to provide a tie which is easy to remove without damage to itself or to the object(s) enclosed;

(c) to provide a tie which is re-usable repeatedly;

(d) to provide a tie whose smaller and variable dimensions permit new and additional uses and potential applications;

(e) to provide a tie which can be offered in a variety of colors to add appeal to consumers;

(f) to provide a tie which can be marketed at a modest price to consumers;

(g) to provide a tie which has many other uses beyond its use as a bag tie, for which it was first conceived;

(h) to provide a tie which does not require any special orientation or mating of parts or segments;

(i) to provide a tie which does not require any extra parts or accessories such as slides, buckles or keepers;

(j) to provide a tie which does not require any special interlocking of parts (aside from the simple mating of surfaces) and does not require the insertion of parts through loops, slits or slots in order to use the tie effectively;

(k) to provide a tie which can be manufactured in a variety of materials to suit a variety of applications;

(l) to provide a tie which can be applied in a clockwise or counterclockwise direction by either a right-handed or a left-handed person;

(m) to provide a tie which can be manufactured in a variety of strengths to suit a variety of applications;

(n) to provide a tie which can be readily extended in length without the need for different materials, parts, or special techniques;

(o) to provide a tie which can be readily shortened simply by cutting one end;

(p) to provide a tie which can be manufactured in a variety of widths and lengths;

(q) to provide a tie which can be manufactured and offered in the marketplace in elastic form;

(r) to provide a tie which can be manufactured and offered in a variety of shear strengths and with different life cycle ratings, these variations to suit particular needs;

(s) to provide a tie which lends itself to convenient storage by the consumer.

SUMMARY

The present invention is a tie in strap form (hooks on one surface of the tie and loops on the opposite surface of the tie). The tie has a special tab on one end (FIG. 4A–14) which facilitates wrapping and tying as described below. In wrapping, the tie attaches to itself.

The special tab can be seen to be a significant help in wrapping the tie lightly and snugly around the objects or objects being enclosed. The tab is of particular value in working with strap-form ties which are narrow in width, e.g., ⅜", where without the tab the thumb would get in the way and make wrapping awkward, difficult and inefficient.

DRAWINGS

Drawing Figures

In the drawings, closely related figures have the same number but different alphabetic suffixes.

Figure 9:
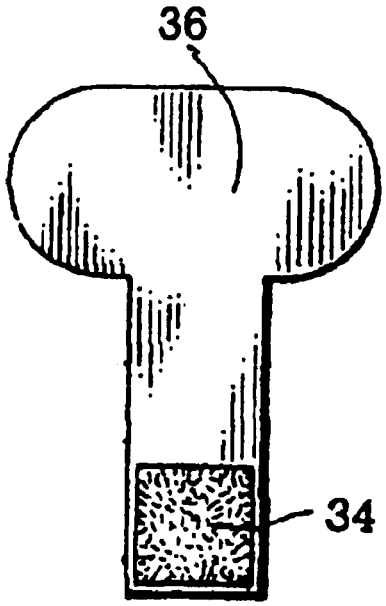
Fig 9 (PRIOR ART)
Figure 10:
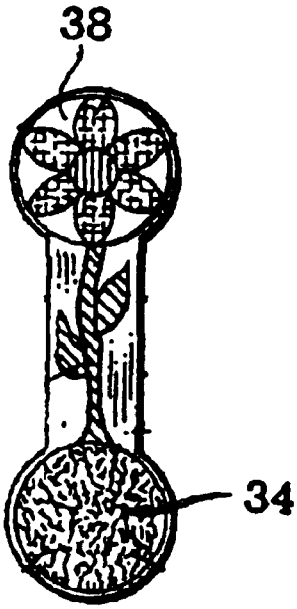
Fig 10 (PRIOR ART)

FIGS. 9 and 10 (PRIOR ART) are top views of two constructions of the shoe lace and knot securing device of the Polk U.S. Pat. No. 5,913,483, these views showing the font surface.

Figure 11:
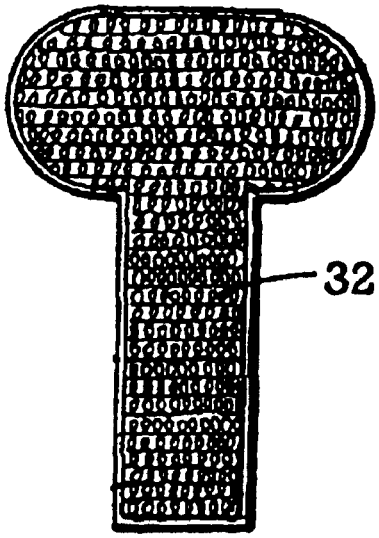
Fig 11 (PRIOR ART)
Figure 12:
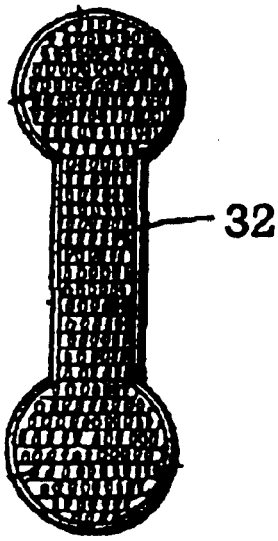
Fig 12 (PRIOR ART)

FIGS. 11 and 12 (PRIOR ART) are top views of the device of FIGS. 9 and 10 showing the rear surface of these devices.

Figure 13:
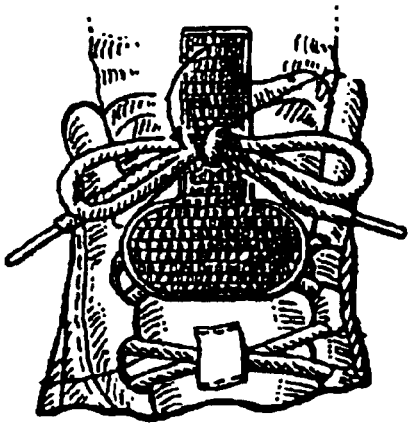
Fig 13 (PRIOR ART)
Figure 14:
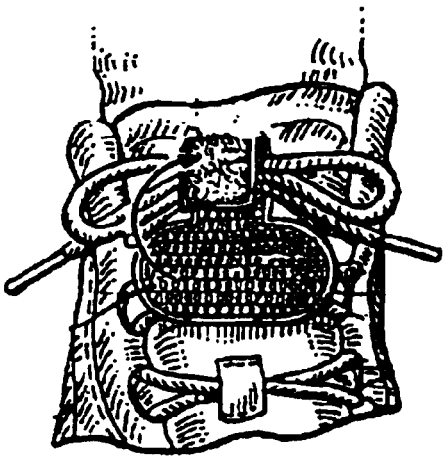
Fig 14 (PRIOR ART)

FIGS. 13 and 14 (PRIOR ART) show one embodiment of the Polk device (U.S. Pat. No. 5,913,483) being applied to shoe laces.

Figure 15:
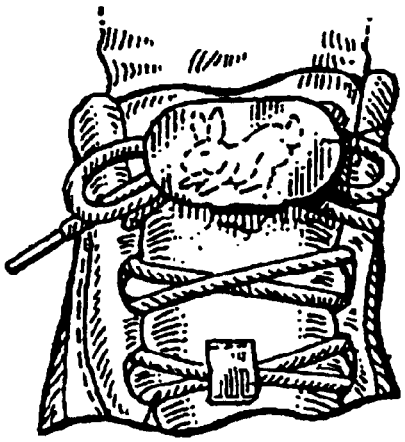
Fig 15 (PRIOR ART)

FIG. 15 (PRIOR ART) is a view of the Polk device after installation is completed, showing that the knot has been covered, the smooth decorated surface outermost.

REFERENCE NUMERALS IN DRAWINGS

10 length of tie in first preferred embodiment

11 width of tab portion

12 width of tie

13 length of tab portion

14 tab

15 tab end

16 slot

18 hook surface

19 tail end of tie

20 loop surface

22 neck of bag

24 opening where bag is inserted

26 loop—the space in which the neck of a bag is held enclosed

28 hook shape

32 rear surface with hook material on it

34 patch with loop material on it

36 smooth surface available for decoration

38 smooth surface with decoration on it

DETAILED DESCRIPTION

The hook and loop fastening system, originally invented and patented more than 40 years ago, then marketed under the Velcro™ brand name, has over the years found many uses in many products and applications. Because of its utility and versatility, it was an extraordinary success. When the patents ran out, other companies entered the market to make and sell products based on the Velcro™ hook and loop concept. Many new uses were found, and continue to be found every day. Many patents have been issued for products which make use of the hook and loop concept. Hook and loop products can be purchased by the consumer and commercial customers in sheet form, in tape form, in squares and dots, and in strap form for binding and bundling purposes. Products can also be die cut for special purposes from sheets of hook and loop material. The Velcro™ concept was an extraordinary invention and offers versatility, utility and convenience that can be exploited in hundreds and hundreds of ways.

We have found a new way to use Velcro™-type hook and loop materials and believe our design to be novel and unique.

The concept of the present invention is extremely simple—so simple in fact that one might be tempted to say, "anyone could have done that." But in all the years that the hook and loop concept has been known and used, no one to our knowledge has ever proposed or made what we have designed in our new tie.

Figure 1:
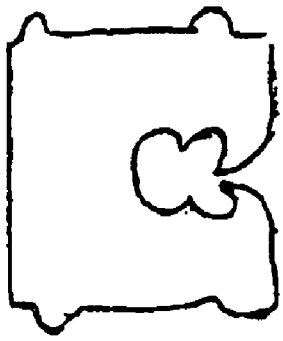
Fig 1 (PRIOR ART)
FIG. 1 (PRIOR ART) is a plan view of a plastic clip typical of those used on bread bags.
Figure 2:
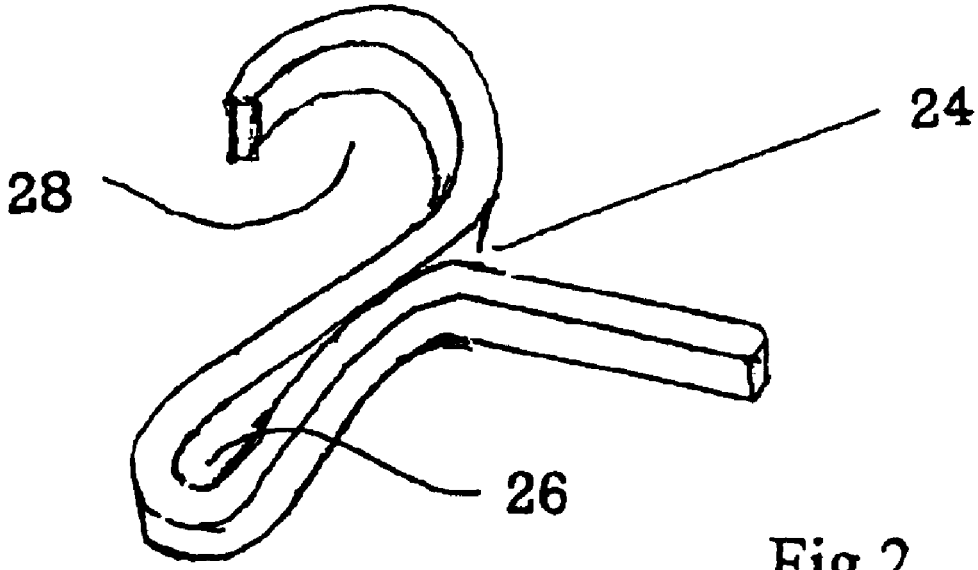
Fig 2 (PRIOR ART)
FIG. 2 (PRIOR ART) is a perspective view of a plastic clip intended as a bread bag closure.
Figure 3A:
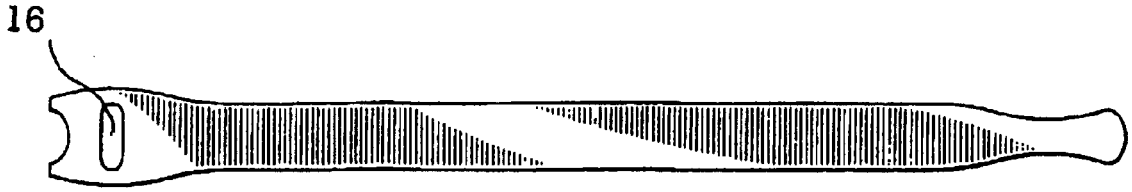
Fig 3A (PRIOR ART)
FIG. 3A (PRIOR ART) is a plan view of a strap-type closure with slot.
Figure 3B:
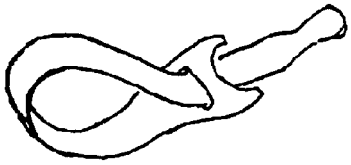
Fig 3B (PRIOR ART)
FIG. 3B (PRIOR ART) shows the end of the strap passing through the slot to aid in anchoring.
Figure 3C:
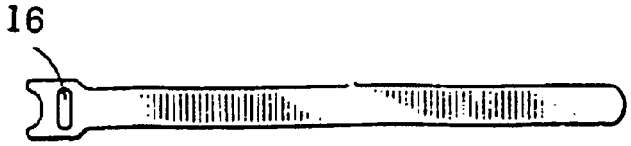
Fig 3C (PRIOR ART)
FIG. 3C (PRIOR ART) shows a variation of a strap tie with a slot.

Hook and loop tapes have been available for many years, but it has been only relatively recently that the self-adhering, back-to-back version of the hook and loop system has become available. (The Velcro™ brand name for this version of the hook and loop system is the "One-Wrap Brand.") Sheets and tapes and rolls of this material are now available, as well as strap ties in finite length and width. One such wrap tie is illustrated in FIG. 3A. The strap-form ties are used as cable ties, for cable and wire management in offices, and for comparable uses throughout the business and industrial world, and in the home. Tapes and ties in the self-adhering version are used to seal bags of many sizes, and to bind and bundle many different products. The strap tie is wrapped around an object or objects, and it overlaps itself in the encirclement. It is pressed onto itself, where it adheres and holds. This is a simple and effective way to tie things up.

Seeing the self-engaging straps referred to above, it occurred to us that the same type of straps could be adapted to use as a bread bag tie. However, the width and length dimensions of the strap we conceived would have to be less than currently available. The hook and loop concept seemed ideal for the purpose, but there was one drawback.

We cut by hand strips of the self-adhering tape material in dimensions we thought appropriate to the task (use as a bread bag tie). But as we tried to wrap the tie tightly and snugly around the neck of the bread bag, our thumb, pressed on one end of the strap to keep it in place while wrapping, kept getting in the way. Neat and simple tying was difficult and awkward. It was then that we conceived of adding a tab at the end of the short and narrow strap tie (see FIGS. 4A, 4B, 5A and 5B). The tab 14 in those illustrations permits one to hold the tie in place while wrapping it tightly and snugly around the neck of the bag while the tie fastens onto itself. The closure now became neat, quick and simple. And because the tie is wrapped under some tension, the tie can be drawn up tight and can be adjusted to conform to the diameter of the neck of the bag (FIG. 6–22). Moreover, with the tab extending both to the left and to the right of the longitudinal body of the tie (as viewed with the longitudinal body in a vertical orientation) the tie can be wrapped with either the left hand or the right hand and in either a clockwise or a counterclockwise direction.

Figure 7:
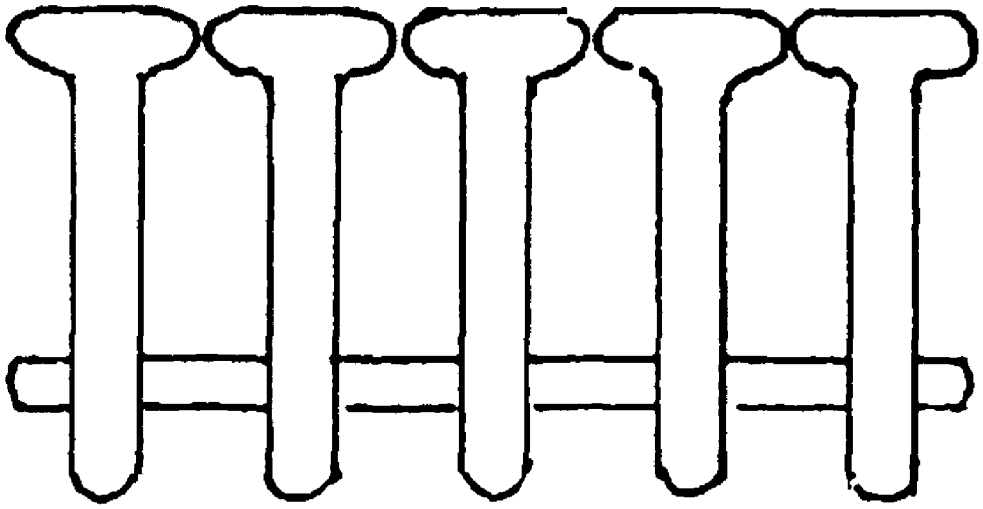
FIG. 7 shows ties attached to an adhesive backed storing strip, a way to store the ties when not in use.
Figure 8A:
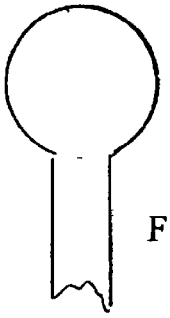
FIGS. 8A to 8L show some possible shapes of the tab end of the tie of the present invention.
Figure 8B:
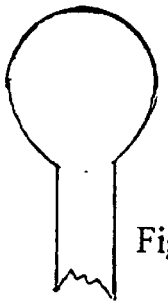
Figure 8C:
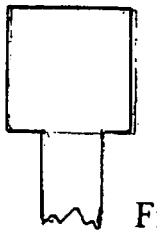
Figure 8D:
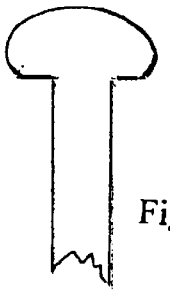
Figure 8E:
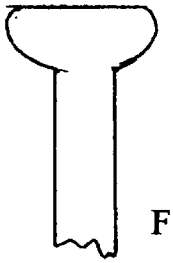
Figure 8F:
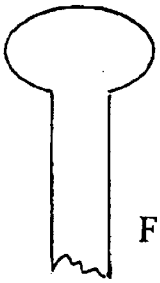
Figure 8G:
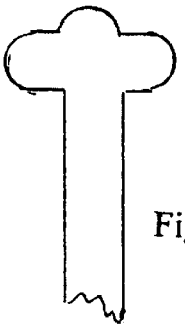
Figure 8H:
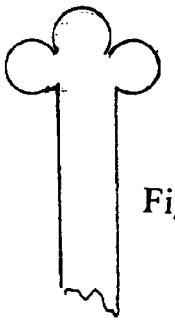
Figure 8I:
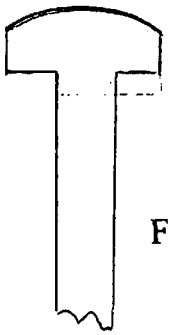
Figure 8J:
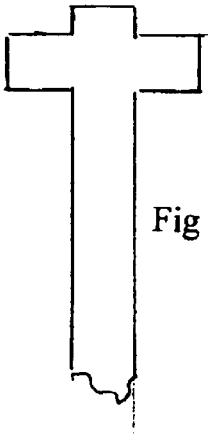
Figure 8K:
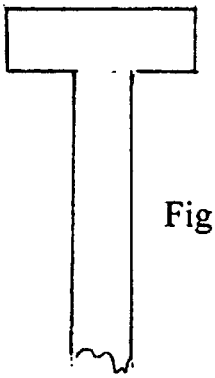
Figure 8L:
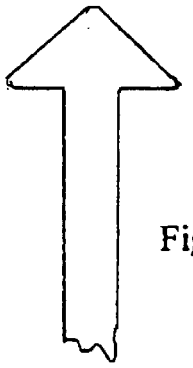

(As a convenience to the consumer, we will supply with our ties an adhesive-backed strip of loop-faced material which can be attached, say, to the side of a bread box, or to the inside of a kitchen cabinet door. The bread bag ties can thus be attached to the storing strip when not in use and to keep them handy. FIG. 7 shows how the ties might look attached to a storing strip.)

It is not unlikely that the idea of a tab on one end of a self-engaging hook and loop strap-form tie never occurred to anyone before because in using straps of wider dimension (as presently available in the marketplace), there is room for the thumb to hold the strap in place while wrapping it tightly around something. However, it is in the narrower widths, e.g., ¼" or ⅜", where the thumb gets in the way while wrapping and the tab is needed.

Figure 4A:
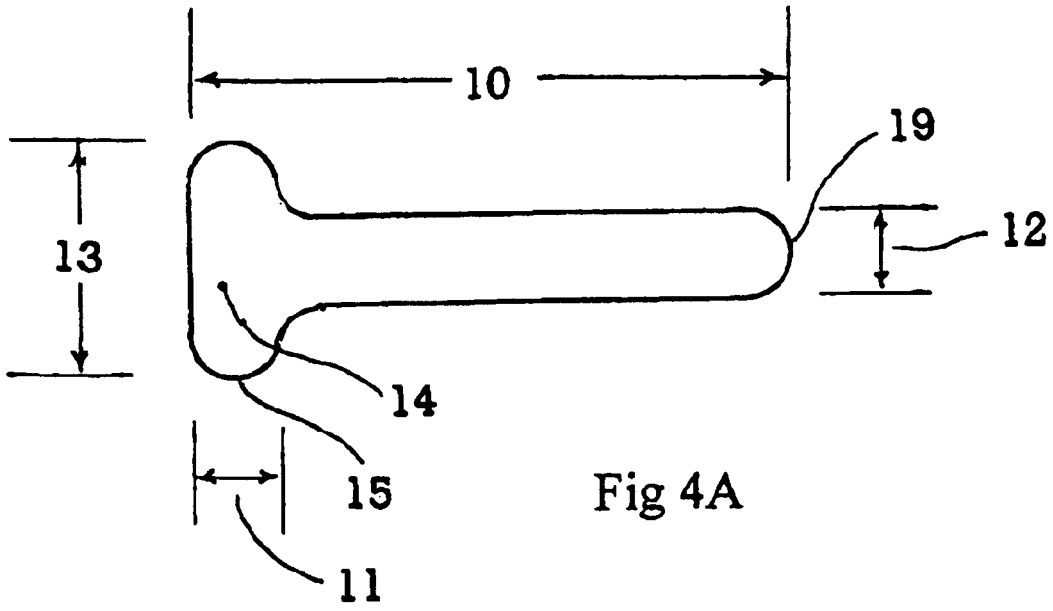
FIG. 4A is a plan view of a preferred embodiment of the present invention showing a special tab at one end of the tie.

A typical configuration of our strap-form tie as used to close and tie a bread bag is illustrated in FIG. 4A. There the tie is shown in approximately actual size as suggested for that particular use. All dimensions, however, may vary from that example.

Figure 4B:
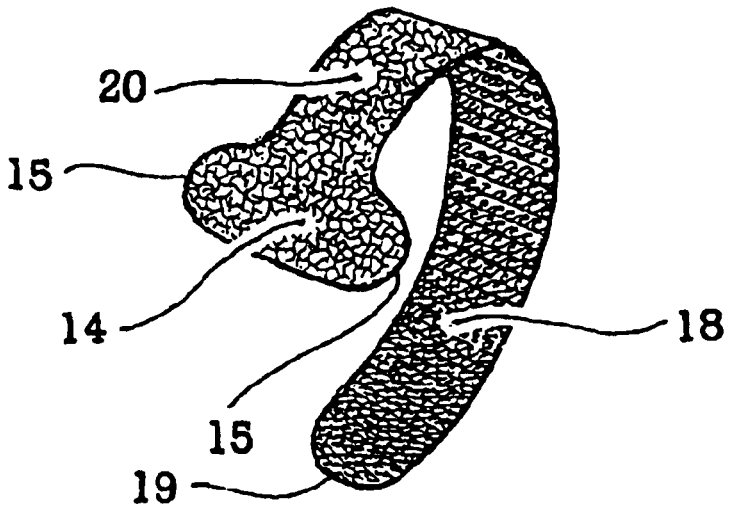
FIG. 4B is a perspective view of the tie with the tail end partially turned as in wrapping to point out the two surfaces (hooks on one surface, loops on the other).

FIG. 4B shows the tail end of the tie turned down as in the beginning of wrapping to point out the hook covered surface and the loop covered surface.

Figures 5A, 5B:
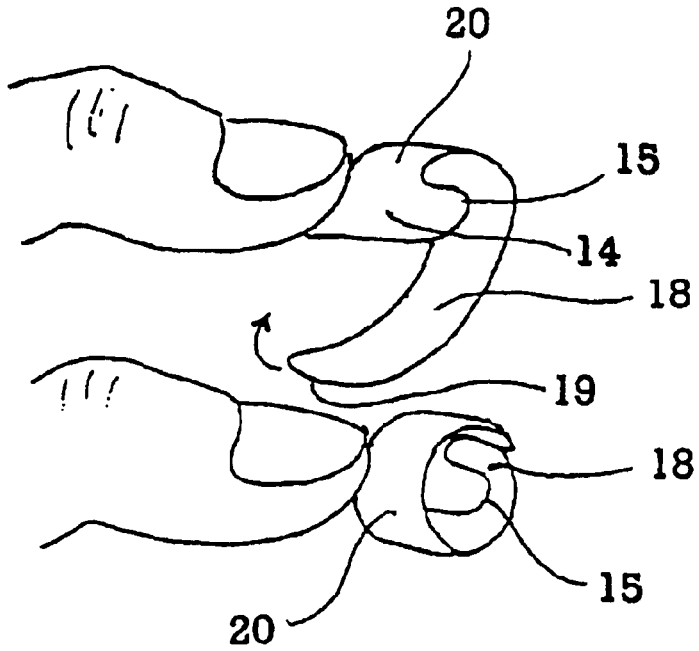
FIG. 5A shows the tie of FIG. 4B, flexing as it would to wrap something, with thumb on the tab end to hold the tie in place while wrapping it tightly.
FIG. 5B shows the tie with wrap completed, the end of the tie fastened to itself.

FIG. 5A shows how the thumb on the tab holds the tie in place while wrapping tightly, hook surface 18 and loop surface 20 identified.

Figure 6:
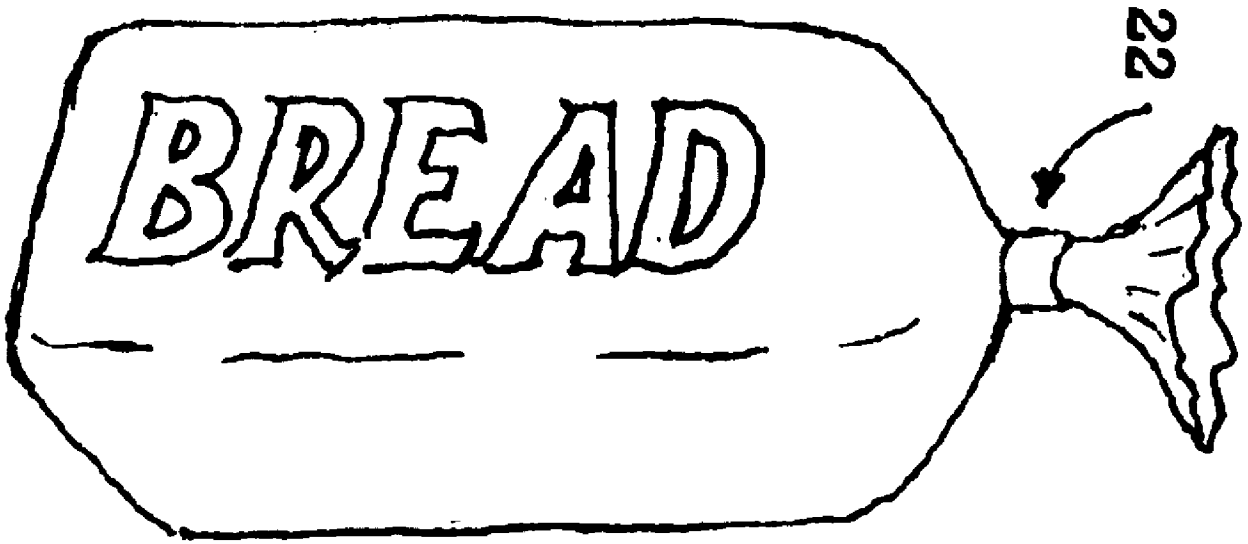
FIG. 6 shows the tie wrapped around the neck of a bread bag—a typical use.

FIG. 6 shows the tie used as a closure for a bread bag.

While the tie of the present invention was initially conceived as a tie for bread bags, it quickly became obvious that the tie we designed would be useful in a wide variety of other applications. Examples of such other applications will be presented later in our Specification.

Additional Embodiments

Additional embodiments based on the fundamental "tie with tab" concept are anticipated as the utility and convenience of our new type of tie are experienced, as new users and potential users, as well as distributors and marketers, discover this new type of tie, and as new applications and potential applications are uncovered.

Some of the additional embodiments conceived for our tie are the following:

(a) variations in the shape of the tab element as suggested in FIGS. 8A to 8L;

(b) variations in all dimensions—length of the tie (FIG. 4A–10), width of the tie (FIG. 4A–12), length of the tab portion (4A–13);

(c) variations in the materials used to make the tie, i.e., their composition;

(d) variations in the specific design of the hook component;

(e) variations in the specific construction of the loop element (e.g., pile, woven, knit material, or, to use the words from U.S. Pat. No. 6,205,623 to Shepard and Clune (2001), "a self-supporting web of entangled fibers");

(f) variations in the relative strength and potential performance of the tie and its components—e.g., different shear strengths, different peel-away strength, different life cycle potential, as well as differences in the design of the hook component (e.g. arrow head, mushroom head, in addition to the more traditional hook designs now being used by various manufactures);

(g) use of stretchable or elastic components.

Advantages

From the foregoing description and discussion, a number of advantages will have become apparent. Our tie (a) is simple in concept, effective in its performance, quick to apply, easy to use, as well as neat in appearance;

(b) is adjustable and removable without damage to itself or to the object(s) enclosed;

(c) is easy to remove simply be peeling it from itself, removable without damage to itself or to the object(s) enclosed;

(d) is re-usable repeatedly without loss of effectiveness;

(e) in its smaller and variable dimensions permits many new additional uses and many new potential applications;

(f) can be offered in a variety of colors to add appeal to consumers;

(g) can be offered at a modest price to consumers;

(h) does not require any special orientation in application, nor does it require any special mating of parts or elements;

(i) does not require the use of any special accessories or attached parts, such as slides, buckles or keepers;

(j) does not require any special interlocking of parts (aside from the simple mating of surfaces) and does not require the insertion of parts through loops, holes, slits or slots in order to use the tie effectively;

(k) can be manufactured in a variety of different materials to suit a variety of applications;

(l) can be applied in a clockwise or counterclockwise direction by either a right-handed or a left-handed person;

(m) can be manufactured and offered in the marketplace in a variety of strengths to suit a variety of applications;

(n) can readily be extended in length without the need of different materials, parts or special techniques;

(o) can be readily shortened if needed by simply cutting off one end;

(p) can be made available in stretchable or elastic form;

(q) lends itself to convenient storage by the consumer.

Operation—FIGS. 4B, 5A and 5B

The closure of the present invention is a strap-form tie of hook and loop material, with hook surface and loop surface back-to-back, so that the strap is self-engaging. In wrapping, it adheres to itself.

To demonstrate operation of the tie of the present invention, let us use the example of its use as a bread bag tie. First, one gathers the open end of the bag and, by giving it a twist, one creates a small diameter neck at the top of the bag. Referring to FIG. 5A, one then applies the strap by placing the tie, loop side up or outward, on the neck of the bag, then one presses the self-engaging strap onto the part of the strap that has encircled the bag. The tie thus adheres to itself. It will so remain until it is released and untied.

Untying is simple. One just picks up the exposed end of the wrapped tie (the tail end, FIG. 4B–19) and peels it away from the rest of the tie.

This action of attaching the tie and releasing it will be familiar to anyone who has used or worked with hook and loop fastening products and systems. This includes most of the population, because hook and loop products are used virtually universally in products in use every day, such as clothing, shoes, hats, purses, bags and handbags, back packs, school bags, luggage, brief cases, cord wraps, in literally hundreds of different products and applications.

The unique feature of the present invention, of course, is the tab. It is the tab that makes it easy to hold the tie in place while wrapping it tightly around something. This feature permits use of smaller dimension ties for applications for which wider and longer ties would be inappropriate.

If the task at hand requires it, the tie of the present invention can be made longer simply by overlapping the end of one tie over the end of a second tie to the extent of ½ or ¾ of an inch, the hook or gripper surface pressed against the loop surface to join the two ties together.

As complicated and involved as the application of the tie may seem to be when described as above in the abstract, the actual wrapping and tying action is extremely simple. Once one has the tie in hand and wraps it around something in the manner described, it will readily be seen that the concept is extraordinarily simple, the wrapping and tying action easy to understand and to do, and the product, especially because of its special tab, a true convenience and a pleasure to use.

To reiterate what we said earlier, the concept of the present invention is so simple that it might appear to approach the obvious. But it is also obvious that the fastener system out of which our design has evolved has been available for some time, yet no one else seems to have ever thought of using Velcro™-type material in quite the way we have. Accordingly, we are of the firm belief that our strap-form tie with special tab is both novel and unobvious.

Conclusions, Ramifications and Scope

The descriptions of the tie of the present invention, its simple concept, its easy-to-understand operations, and the list of advantages presented above, should make it apparent that our tie brings to the marketplace an attractive new convenience that should have broad appeal in a wide variety of applications and potential uses. Although the descriptions above contain specifications for certain embodiments and applications, these should not be construed as limiting the scope of the invention, but should be understood as merely providing examples of embodiments and applications which can be conceived for this invention. Thus, the scope of the invention should be determined by the appended claims and their legal equivalents rather than limited by examples given.

We claim:

1. A strap-form tie made of self-engaging back-to-back hook and loop materials, with a hook component disposed on one face of said tie, the hook component covering the entire surface of said one face of said tie, and a loop component disposed on an opposite face of said tie, said loop component covering the entire surface of said opposite face of said tie, wherein said strap-form tie having a longitudinal body that is essentially rectangular in shape, is generally uniform in width, and is of predetermined length, and wherein said tie includes a tab portion of the tie at one end of said tie in an orientation generally perpendicular to the longitudinal body of said tie, said tab portion making said one end of said tie wider than the width of said longitudinal body of said tie, said tab portion of predetermined shape and of predetermined dimension, said tab portion forming a tab shape at said one end of said tie, said tab shape essentially a T shape, wherein said tab shape extends to a predetermined and equidistant extent both to the left and to the right of said longitudinal body of said tie as viewed with said longitudinal body in a vertical orientation, said predetermined extent being sufficient to accommodate comfortably the thumb of one hand of an adult person pressed on an end of said tab to hold said tie in place preparatory to wrapping, said tie overlapping itself in the process of wrapping, and, by means of pressing said hook surface against said loop surface, the two said surfaces thus becoming inter-engaged, thus accomplishing a tying function;

said tie requiring no additional parts or accessories, and having no holes, slits, slots or apertures involved in its tying function;

said tie also requiring no special orientation or mating of parts, other than simply overlapping itself in order to accomplish its tying and holding function.

2. The strap-form tie of claim 1 wherein said tie is adjustable so that it will conform to the diameter of the object or objects being enclosed.

3. The strap-form tie of claim 1 wherein said tie is intended to encircle and tie the gathered neck of a bag of plastic, paper, cloth or other flexible material, regardless of the dimensions of said neck.

4. The strap-form tie of claim 1 wherein said tie is intended to encircle, wrap and tie objects such as wires, cable, fibers, strips, tubes, and other objects in a bundling type of operation.

5. The strap-form tie of claim 1 wherein the untying and release of said tie from its inter-engaged state are accomplished by a peeling action, wherein the exposed end of said tie, which might be called the tail end, which has encircled and tied an object or objects, is grasped and pulled away from itself, said hook surface easily and effectively disengaging and separating from said loop surface, thus releasing said tie from its inter-engaged state.

6. The strap-form tie of claim 1 wherein said tab shape is rectangular or oblong in shape and wherein all corners are rounded.

7. The strap-form tie of claim 1 wherein said tab formed at said one end of said tie is made of different geometric shapes selected from the group consisting of a square shape, rectangular shape, round shape, oval shape, clover leaf shape, cross shape, triangular shape, arrowhead shape, mushroom shape, barrel shape, polygonal, hexagonal and octagonal shapes.

* * * * *

UNITED STATES PATENT AND TRADEMARK OFFICE

CERTIFICATE OF CORRECTION

PATENT NO. : 6,763,554 B1
DATED : July 20, 2004
INVENTOR(S) : Ralph H. Torrey and Lis N. Torrey It is certified that error appears in the above-identified patent and that said Letters Patent is hereby corrected as shown below:

Title page,
Item [57], ABSTRACT, within the parentheses, the sentence should read -- hooks on one surface of the tie --, Column 2,
Line 37, need a space between "tubing" and the word "and"
Line 42, phrase "Pat. No. 6,044,525 to Satire", should read -- to Sastre --, Column 3,
Line 3, phrase should read -- as presently marketed --, Column 5,
Line 22, should read -- other types and sizes --
Line 30, delete word "in" in phrase "The advantages inherent in", Column 6,
Line 30, phrase should read -- wrapping the tie tightly and snugly --, Column 7,
Line 4, phrase should read -- front surface --, Column 9,
Line 50, phrase should read -- is easy to remove simply by peeling --, Column 11,
Line 8, phrase should read -- its easy to understand operation --.

Signed and Sealed this

Fourteenth Day of December, 2004

JON W. DUDAS
*Director of the United States Patent and Trademark Office*